US005788151A

United States Patent [19]

Moroi et al.

[11] Patent Number: 5,788,151

[45] Date of Patent: Aug. 4, 1998

[54] VISCOUS FLUID TYPE HEAT GENERATORS

[75] Inventors: Takahiro Moroi; Takashi Ban; Fumihiko Kitani; Tsutomu Sato, all of Kariya, Japan

[73] Assignee: Kabushiki Kaisha Toyoda Jidoshokki Seisakusho, Kariya, Japan

[21] Appl. No.: 946,264

[22] Filed: Oct. 7, 1997

[30] Foreign Application Priority Data

Oct. 9, 1996 [JP] Japan ..... 8-268259

[51] Int. Cl.[6] ..... B60H 1/02

[52] U.S. Cl. ..... 237/12.3 R; 237/12.3 B; 122/26; 126/247

[58] Field of Search ..... 237/12.3 R, 12.3 B; 122/26; 126/247

[56] References Cited

U.S. PATENT DOCUMENTS 5,573,184 11/1996 Martin .

FOREIGN PATENT DOCUMENTS 2246823 10/1990 Japan .
357877 3/1991 Japan .

*Primary Examiner*—Henry A. Bennett
*Assistant Examiner*—Derek S. Boles
*Attorney, Agent, or Firm*—Burgess, Ryan & Wayne

[57] ABSTRACT

A viscous fluid type heat generator includes a housing assembly defining a heat generating chamber and a heat receiving chamber for permitting a heat exchanging fluid to circulate therethrough to receive heat from the heat generating chamber. A rotor element is supported by the housing assembly separately from the drive shaft to be rotationally driven by the drive shaft for rotation within the heat generating chamber. A viscous fluid is held in a gap defined between the inner wall surfaces of the heat generating chamber and the outer faces of the rotor element, for heat generation under a shearing stress applied by the rotation of the rotor element. Frictional coupling means are provided for frictionally coupling the drive shaft with the rotor element and for mechanically transmitting a rotation of the drive shaft to the rotor element to permit the rotor element to rotate in the heat generating chamber at a speed not higher than a predetermined thermal limit speed. If the rotation speed of the rotor element 22 exceeds the predetermined thermal limit speed, the viscous fluid could generate excessive heat, which would probably accelerate the thermal degradation of the viscous fluid.

20 Claims, 6 Drawing Sheets

VISCOUS FLUID TYPE HEAT GENERATORS

BACKGROUND OF THE INVENTION

1. Field of the Invention

The present invention relates to a viscous fluid type heat generator which includes a housing provided with a heat generating chamber and a heat receiving chamber separated from each other, and a rotor element for shearing a viscous fluid contained in the heat generating chamber to generate heat that is in turn transmitted to a heat exchanging fluid circulating through the heat receiving chamber to be carried by the heat exchanging fluid to a desired area to be heated. The present invention may be considered to be a supplementary heat source incorporated in a vehicle heating system.

2. Description of the Related Art

A viscous fluid type heat generator driven for operation by the driving force of a vehicle engine is known in the art. For example, Japanese Unexamined Patent Publication (Kokai) No. 2-246823 (JP-A-2-246823) discloses an automobile heating system provided with such a viscous fluid type heat generator. In this heating system, the viscous fluid type heat generator is provided in a hot water circuit, in which an engine cooling water discharged from the outlet port of a water pump driven by an engine flows through a heater core or heat exchanger for heating a passenger compartment and returns into the water pump via the inlet port of the water pump. The viscous fluid type heat generator is operated when the temperature of the engine cooling water circulating through the hot water circuit is not higher than a predetermined temperature.

In this viscous fluid type heat generator, a front housing and a rear housing are combined and fastened together with through bolts, to define a heat generating chamber and a heat receiving chamber arranged to surround the heat generating chamber. The heat generating chamber is isolated from the heat receiving chamber by a partition wall through which heat is exchanged between a viscous fluid in the heat generating chamber and a heat exchanging fluid in the heat receiving chamber. The heat exchanging fluid is introduced through an inlet port into the heat receiving chamber, and is delivered through an outlet port from the heat receiving chamber to an external heating circuit.

A drive shaft is supported for rotation by a bearing in the front housing, and a rotor element is fixedly mounted on the drive shaft in such a manner as to be able to rotate within the heat generating chamber. The rotor element includes outer faces arranged face-to-face with the inner wall surfaces of the heat generating chamber to define therebetween small gaps in the shape of labyrinth grooves. A viscous fluid, such as silicone oil, is supplied into the heat generating chamber to fill the small gaps between the outer faces of the rotor element and the inner wall surfaces of the heat generating chamber. The small gaps are defined by a plurality of annular ridges projecting from both the inner surfaces of the heat generating chamber and the outer faces of the rotor element.

When the output torque of the automobile engine is transmitted through an electromagnetic clutch to the drive shaft of the above viscous fluid type heat generator to rotationally drive the drive shaft, the rotor element is also rotated within the heat generating chamber. At this time, the rotating rotor element provides a shearing stress to the viscous fluid held between the inner wall surfaces of the heat generating chamber and the outer faces of the rotor element to generate heat. The generated heat is then transmitted from the viscous fluid to the heat exchanging fluid circulating through the heat receiving chamber, and the heat exchanging fluid carries the transmitted heat to the heating circuit of the automobile heating system to heat a passenger compartment.

Japanese Unexamined Patent Publication (Kokai) No. 3-57877 (JP-A-3-57877) also discloses an automobile heating system provided with a viscous fluid type heat generator of another structure. In this heat generator, front and rear housings are combined and fastened together with bolts to define a heat receiving chamber, and a rotative body consisting of front and rear casings fastened together with bolts is enclosed within the heat receiving chamber. The front and rear casings define therein a heat generating chamber, in which a rotor element is enclosed with small gaps defined between the inner surfaces of the heat generating chamber and the outer faces of the rotor element.

A drive shaft is supported for rotation by a bearing on the front housing, and the rotor element is fixed to an end portion of the drive shaft for rotation together with the drive shaft. The front casing is rotatably supported by a rolling bearing on the drive shaft. The rear casing is provided with an impeller on the outer peripheral surface of the rear casing.

When the output torque of the automobile engine is transmitted through an electromagnetic clutch to the drive shaft of the above viscous fluid type heat generator to rotationally drive the drive shaft, the rotor element is also rotated within the heat generating chamber together with the drive shaft. At this time, the rotative body tends to follow the rotor element for rotation together therewith due to the fluid friction of a viscous fluid held in the small gaps between the inner wall surfaces of the heat generating chamber and the outer faces of the rotor element, but is suppressed for rotation due to the fluid resistance exerted on the impeller by a heat exchanging fluid which circulates through the heat receiving chamber via inlet and outlet ports provided in the rear housing.

Consequently, the rotor element rotates in the heat generating chamber relative to the rotative body, and thereby provides a shearing action to the viscous fluid held between the inner wall surfaces of the heat generating chamber and the outer faces of the rotor element to generate heat. The generated heat is then transmitted from the viscous fluid to the heat exchanging fluid which in turn carries the transmitted heat to the heating circuit of the automobile heating system to heat a passenger compartment.

In the conventional viscous fluid type heat generators, it is known that a heat generating rate, at which heat is generated in the viscous fluid applied with a shearing stress by the outer faces of the rotor element, is proportional to the square of the rotating speed (angular velocity) of the rotor element. Since the rotation of the output shaft of the engine is transmitted to the drive shaft of the viscous fluid type heat generator, the rotating speed of the rotor element directly depends on the engine speed.

Therefore, the conventional viscous fluid type heat generator has a problem of an excessive heat generation when the engine operates at such a high speed that the temperature of the viscous fluid in the heat generating chamber rises and exceeds the limit of the heat resistant properties of the viscous fluid, which ultimately degrades the viscous fluid. The degradation of the viscous fluid reduces the viscosity of the viscous fluid. Consequently, the amount of heat generated with every turn of the rotor element is reduced, which makes it difficult to obtain the necessary amount of heat generation in the conventional viscous fluid type heat generator, and which results in the reduction of the operating performance of the heat generator.

Such a problem may be solved by one solution in which the electromagnetic clutch is actuated into a disengaged state to disconnect the heat generator from the engine while the engine is operating at a high speed exceeding a predetermined limit speed, and is actuated into an engaged state to connect the heat generator with the engine while the engine is operating at a speed not higher than the limit speed to transmit the output torque of the engine to the drive shaft of the heat generator. However, since the electromagnetic clutch can be controlled only in an on-off control mode, the electromagnetic clutch is frequently switched between the engaged and disengaged states when the engine speed varies frequently in a range around the limit speed for avoiding the excessive heat generation of the heat generator.

This causes other problems in that the durability of the electromagnetic clutch is deteriorated and shocks generated at every time of the switching of the electromagnetic clutch spoil the drivability of the vehicle. Further problems are that the engine speed must be measured by a speed sensor for the on-off control of the electromagnetic clutch, which may complicate the on-off control, and that, if the engine speed sensor does not function properly, the viscous fluid type heat generator is driven for an undesirable operation which generates heat at an excessively high heat generating rate.

In the viscous fluid type heat generator disclosed in JP-A-3-57877, the rotative body rotates in the heat receiving chamber at a speed lower than the speed of the rotor element when the rotor element rotates in the heat generating chamber, whereby the viscous fluid is applied with a shearing stress by the rotor element rotating relative to the rotating body. Accordingly, the relative rotating speed of the rotor element, significant for applying the shearing stress to the viscous fluid, is lower than the rotating speed of the drive shaft, and this structure is different from that of the conventional heat generator including a fixed heat generating chamber, such as the heat generator described in JP-A-2-246823. However, this structure cannot prevent the excessive heat generation of the heat generator because the rotating speed of the rotor element relative to the heat generating chamber is also increased as the rotating speed of the drive shaft is increased.

SUMMARY OF THE INVENTION

Therefore, an object of the present invention is to provide a viscous fluid type heat generator provided with a simple mechanism to prevent an excessive heat generation even when a drive shaft for driving a rotor element rotates at a speed exceeding a predetermined level.

In accordance with the present invention, there is provided a viscous fluid type heat generator comprising a housing assembly defining therein a heat generating chamber in which heat is generated, and a heat receiving chamber arranged adjacent to the heat generating chamber for permitting a heat exchanging fluid to circulate through the heat receiving chamber to thereby receive heat from the heat generating chamber, the heat generating chamber having inner wall surfaces thereof; a drive shaft supported by the housing assembly to be rotatable about an axis of rotation of the drive shaft, the drive shaft being operationally connected to an external rotation-drive source; a rotor element supported by the housing assembly separately from the drive shaft to be rotationally driven by the drive shaft for rotation within the heat generating chamber, the rotor element having outer faces confronting the inner wall surfaces of the heat generating chamber via a predetermined gap defined therebetween; a viscous fluid, held in the gap defined between the inner wall surfaces of the heat generating chamber of the housing assembly and the outer faces of the rotor element, for heat generation under shearing stress applied by the rotation of the rotor element; and frictional coupling means for frictionally coupling the drive shaft with the rotor element and for mechanically transmitting a rotation of the drive shaft to the rotor element to permit the rotor element to rotate in the heat generating chamber at a speed not higher than a predetermined thermal limit speed.

It is advantageous that the frictional coupling means permits the rotor element to rotate together with the drive shaft at substantially the rotation speed of the drive shaft when a fluidic friction torque exerted by the viscous fluid onto the rotor element is not larger than a predetermined maximum torque transmittable by the frictional coupling means to the rotor element.

It is also advantageous that the frictional coupling means permits the rotor element to rotate at a speed lower than a rotation speed of the drive shaft in a state where the frictional coupling means frictionally slides on the rotor element when a fluidic friction torque exerted by the viscous fluid onto the rotor element exceeds a predetermined maximum torque transmittable by the frictional coupling means to the rotor element.

In either case, it is preferred that the predetermined maximum torque substantially corresponds to a fluidic friction torque exerted by the viscous fluid onto the rotor element rotating at the predetermined thermal limit speed.

The rotor element may be provided with an axle member axially oppositely extending from the rotor element along a rotation axis of the rotor element, the axle member being coaxially arranged with the drive shaft.

In this arrangement, the frictional coupling means may comprise a spring coil element having a first end fixed to the drive shaft and an opposed second end frictionally engaged with the axle member with a radially inner surface of the spring coil element being in close contact with at least an outer circumferential surface of the axle member.

The spring coil element may permit the rotor element to rotate together with the drive shaft at substantially a rotation speed of the drive shaft when a fluidic friction torque exerted by the viscous fluid onto the rotor element is not larger than a predetermined maximum torque transmittable by the spring coil element to the axle member.

The spring coil element may also permit the rotor element to rotate at a speed lower than a rotation speed of the drive shaft in a state where the spring coil element frictionally slides on the axle member when a fluidic friction torque exerted by the viscous fluid onto the rotor element exceeds a predetermined maximum torque transmittable by the spring coil element to the axle member.

In either case, it is preferred that the predetermined maximum torque substantially corresponds to a fluidic friction torque exerted by the viscous fluid onto the rotor element rotating at the predetermined thermal limit speed.

Alternatively, the frictional coupling means may comprise a plurality of frictional coupling members, each of which is supported on the drive shaft for radial movement and has a radially inner surface capable of coming into contact with an outer circumferential surface of the axle member, and biasing means for biasing the frictional coupling members to bring the inner surface of each frictional coupling member into contact with the outer circumferential surface of the axle member.

The frictional coupling members may permit the rotor element to rotate together with the drive shaft at substantially a rotation speed of the drive shaft when a fluidic friction torque exerted by the viscous fluid onto the rotor element is not larger than a predetermined maximum torque transmittable by the frictional coupling members to the axle member.

In this arrangement, the heat generator may further comprise friction enhancing means provided on at least one of the radially inner surface of each frictional coupling member and the outer circumferential surface of the axle member.

The frictional coupling members may also permit the rotor element to rotate at a speed lower than a rotation speed of the drive shaft in a state where the frictional coupling members frictionally slides on the axle member when a fluidic friction torque exerted by the viscous fluid onto the rotor element exceeds a predetermined maximum torque transmittable by the frictional coupling members to the axle member.

In either case, it is preferred that the predetermined maximum torque substantially corresponds to a fluidic friction torque exerted by the viscous fluid onto the rotor element rotating at the predetermined thermal limit speed.

The biasing means may be a spring capable of maintaining the frictional coupling members in contact with the outer circumferential surface of the axle member when the drive shaft rotates at a speed not higher than a predetermined level associated with the predetermined maximum torque.

The biasing means may also include a plurality of extension springs arranged between mutually adjacent frictional coupling members.

The axle member may include a section extending away from the drive shaft, the section being rotationally supported in a cantilever fashion by a bearing mounted on the housing assembly.

In this arrangement, the bearing may be mounted on the housing assembly in an axially shiftable manner, and a locating spring may be arranged between the bearing and the housing assembly for locating the rotor element at a proper position to define the predetermined gap in the heat generating chamber by biasing the bearing in such a direction that an axial end face of the axle member comes into contact with a confronting axial end face of the drive shaft.

It is preferred that at least one of the axial end faces of the axle member and the confronting axial end face of the drive shaft is provided with a protrusion for reducing kinetic friction between these axial end faces.

Alternatively, the bearing may be mounted on said housing assembly in a fixed manner, and the rotor element may be located at a proper position to define the predetermined gap in the heat generating chamber by the bearing independently of a mutual contact between an axial end face of the axle member and a confronting axial end face of the drive shaft.

BRIEF DESCRIPTION OF THE DRAWINGS

The above and other objects, features and advantages of the present invention will become more apparent from the following description of preferred embodiments in connection with the accompanying drawings, in which.

DETAILED DESCRIPTION OF THE PREFERRED EMBODIMENTS

Figure 1:
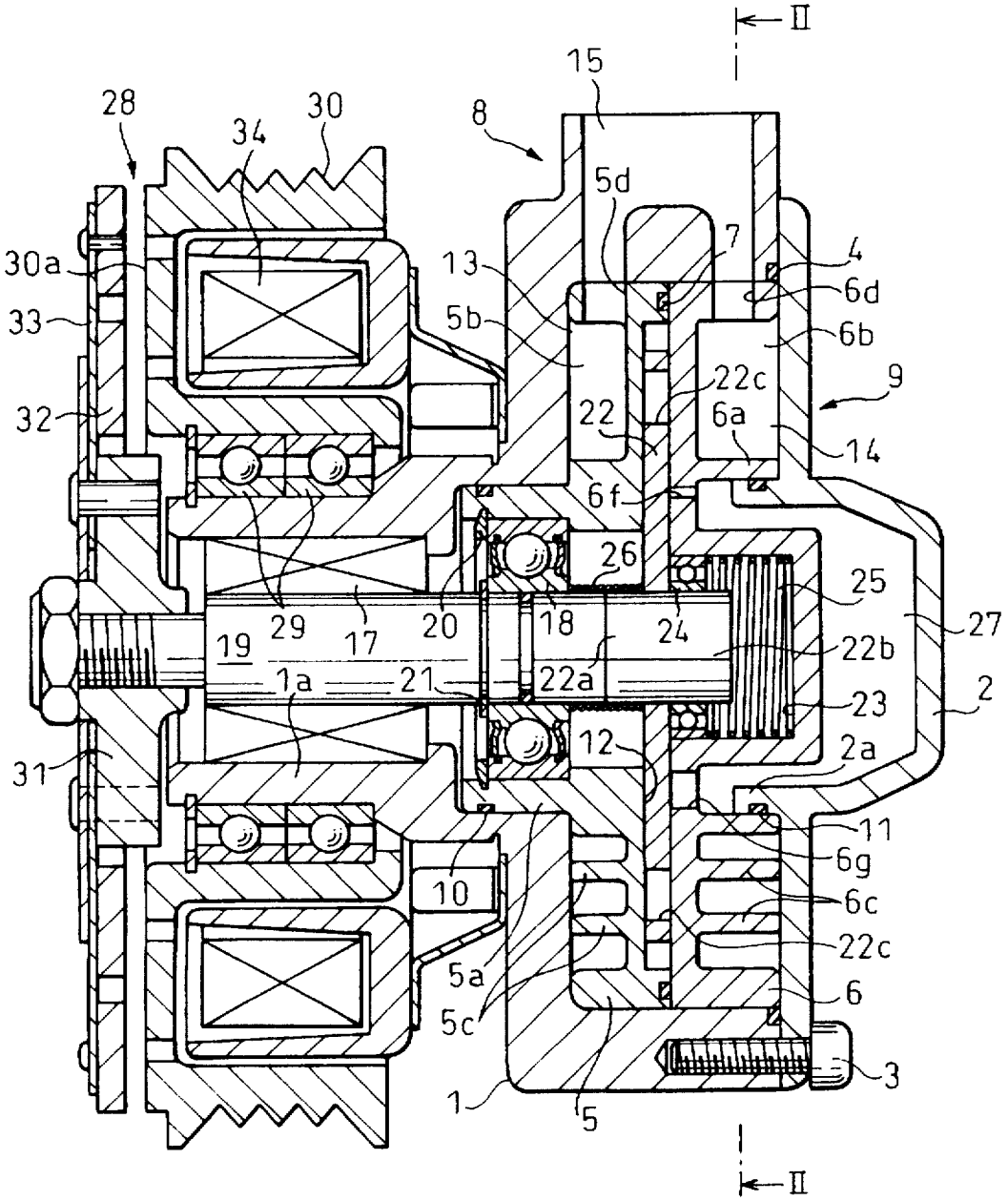
FIG. 1 is a longitudinal sectional view of a first embodiment of a viscous fluid type heat generator according to the present invention, taken along a line I—I of FIG. 2.
Figure 2:
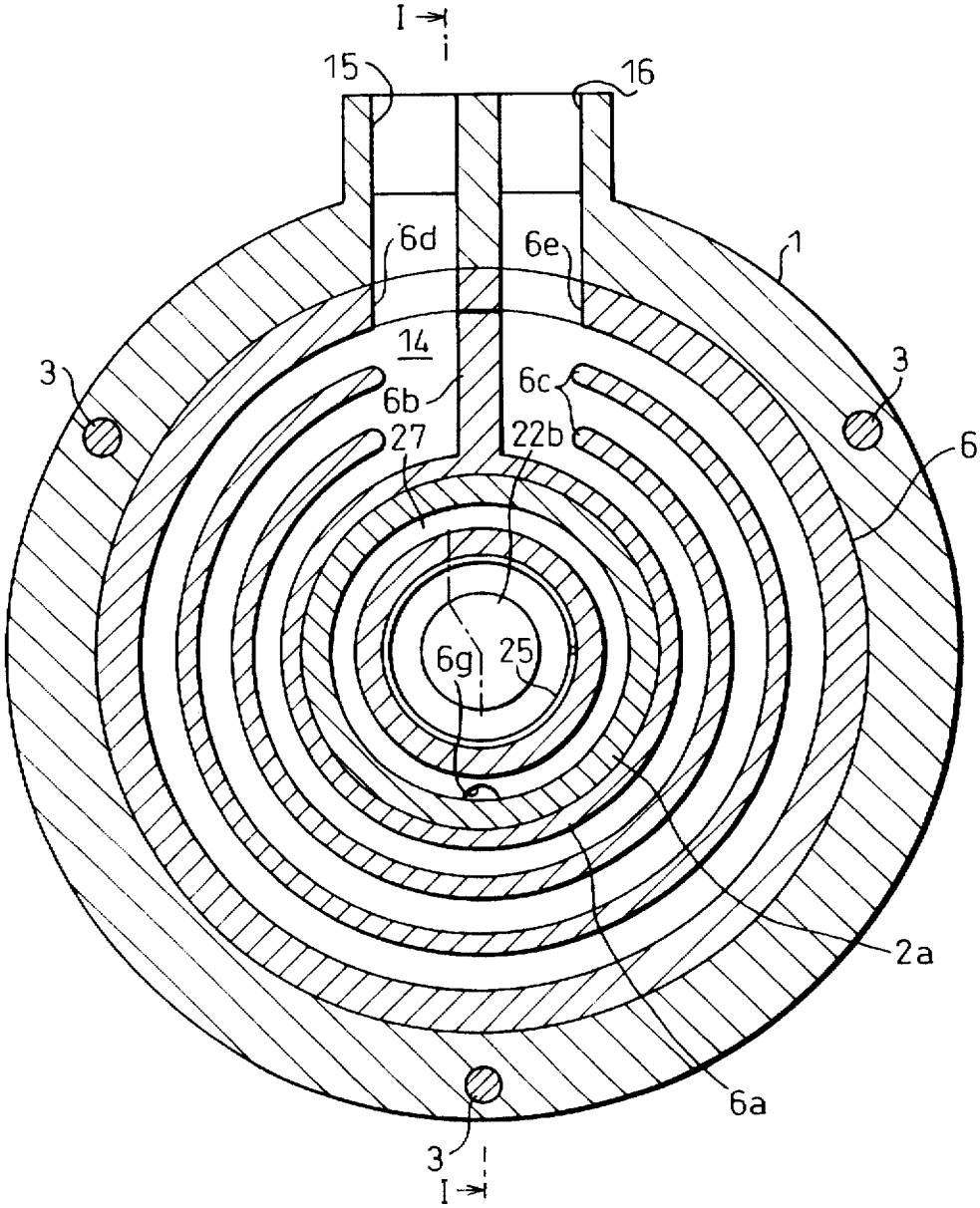
FIG. 2 is a sectional view taken along a line II—II of FIG. 1.
Figure 3:
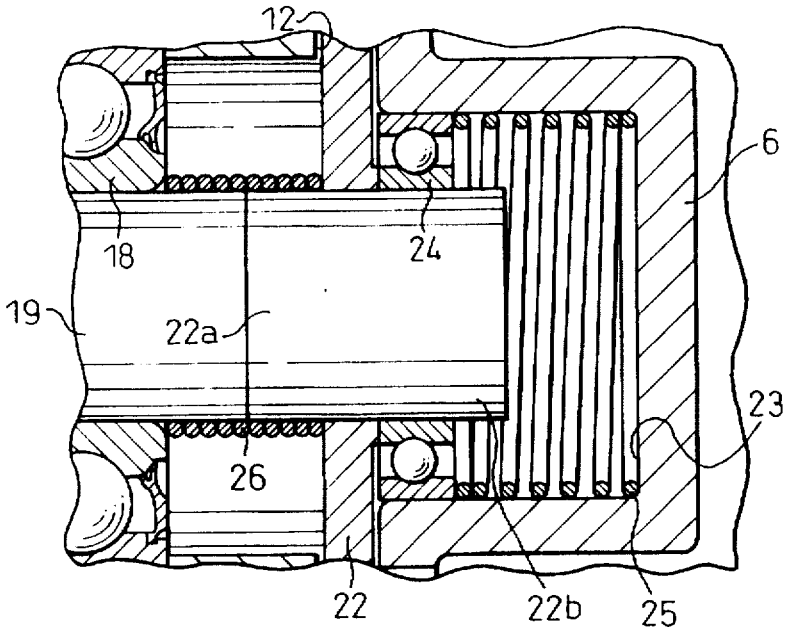
FIG. 3 is an enlarged fragmentary longitudinal sectional view showing a structural portion for coupling a rotor element with a drive shaft.

Referring now to the drawings, wherein the same or similar components are designated by the same reference numerals, FIGS. 1 to 3 show a first embodiment of a viscous fluid type heat generator according to the present invention, which is adapted to be incorporated in a vehicle heating system.

The heat generator of the first embodiment includes a front housing body 1, a rear housing body 2, a front partition plate 5 and a rear partition plate 6. The front housing body 1 includes a cup-shaped section defining therein a cup-shaped recess, and a center boss 1*a* axially frontwardly extending from the cup-shaped section to define therein a center through bore. The rear housing body 2 includes a flat annular plate section and a center bulge axially rearwardly extending from the annular plate section. The front housing body 1 is closed at a rear-opening end of the cup-shaped recess thereof by the rear housing body 2 through the interposition of an O-ring 4 hermetically sealing the outer peripheral regions of the cup-shaped section and the annular plate section, and axially and tightly combined with the rear housing body 2 by a plurality of screw bolts 3 (only one bolt 3 is shown in FIG. 1).

The front and rear partition plates 5, 6 are stacked with each other through the interposition of an O-ring 7 hermetically sealing the outer peripheral regions of the mutually opposed surfaces of the partition plates 5, 6, and housed in the cup-shaped recess of the front housing body 1. The front and rear partition plates 5, 6 may be made of any material having a high thermal conductivity, and are preferably made of aluminum or an aluminum alloy. The front housing body 1 and the front partition plate 5 form a front housing assembly 8 of the heat generator, and the rear housing body 2 and the rear partition plate 6 form a rear housing assembly 9 of the heat generator.

The front partition plate 5 includes a radially outer annular part with axially opposed front and rear faces, and a center cylindrical support part 5a axially frontwardly extending from the inner edge of the annular part. The cylindrical support part 5a is fitted inside the center through the bore of the front housing body 1. An O-ring 10 is arranged in a groove formed in the outer circumferential surface of the cylindrical support part 5a, to hermetically seal the support part 5a and the front housing body 1, even when they are loosely fitted with each other.

The rear partition plate 6 includes a radially outer annular part with axially opposed front and rear faces, and a center bulge axially rearwardly extending from the inner edge of the annular part. The rear partition plate 6 also includes a cylindrical part 6a axially rearwardly extending from the annular part along the center bulge of the rear partition plate 6. On the other hand, the rear housing body 2 also includes a cylindrical support part 2a axially frontwardly extending from the inner edge of the annular plate section thereof, and the cylindrical part 6a of the rear partition plate 6 is fitted outside the cylindrical support part 2a. An O-ring 11 is arranged in a groove formed in the outer circumferential surface of the cylindrical support part 2a, to hermetically seal the cylindrical part 6a and the rear housing body 2, even when they are loosely fitted with each other.

The flat rear face of the annular part of the front partition plate 5 is provided with an annular recess formed therein. A flat annular bottom face and a cylindrical circumferential face of the annular recess formed in the front partition plate 5 cooperate with the flat front face of the annular part of the rear partition plate 6 to define a heat generating chamber 12.

The front face of the annular part of the front partition plate 5 is also provided with a division wall 5b axially frontwardly projecting from the front face and radially outwardly extending from the cylindrical support part 5a, two C-shaped ridges 5c axially frontwardly projecting from the front face and concentrically extending around the cylindrical support part 5a, the opposed edges of each ridge 5c being separated from the division wall 5b, and an outermost annular ridge axially frontwardly projecting from the outer edge of the front face and concentrically extending around the C-shaped ridges 5c.

The inner wall face of the cup-shaped recess of the front housing body 1 cooperates with the front face of the front partition plate 5, involving the faces of support part 5a, division wall 5b, C-shaped ridges 5c and the annular ridge, to define a C-shaped front heat receiving chamber 13 arranged near the front side of the heat generating chamber 12. The front edges of the division wall 5b, C-shaped ridges 5c and annular ridge are in contact with the inner wall face of the front housing body 1. The front heat receiving chamber 13 is separated in a fluid-tight manner from the heat generating chamber 12 by the front partition plate 5 interposed therebetween.

As best seen in FIG. 2, the rear face of the annular part of the rear partition plate 6 is also provided with a division wall 6b axially rearwardly projecting from the rear face and radially outwardly extending from the cylindrical part 6a, two C-shaped ridges 6c axially rearwardly projecting from the rear face and concentrically extending around the cylindrical part 6a, the opposed edges of each ridge 6c being separated from the division wall 6b, and an outermost annular ridge axially rearwardly projecting from the outer edge of the rear face and concentrically extending around the C-shaped ridges 6c.

The inner wall face of the annular plate section of the rear housing body 2 cooperates with the rear face of the rear partition plate 6 in the area radially outside the cylindrical part 6a, involving the faces of cylindrical part 6a, division wall 6b, C-shaped ridges 6c and the annular ridge, to define a C-shaped rear heat receiving chamber 14 arranged near the rear side of the heat generating chamber 12. The rear edges of the division wall 6b, C-shaped ridges 6c and the annular ridge are in contact with the inner wall face of the rear housing body 2. The rear heat receiving chamber 14 is separated in a fluid-tight manner from the heat generating chamber 12 by the rear partition plate 6 interposed therebetween.

An inlet port 15 and an outlet port 16 are formed in the outer circumference of the cup-shaped section of the front housing body 1 at a respective position adjacent to the opposite sides of both the division walls 5b, 6b of the front and rear partition plates 5 and 6. The partition plate 5 is provided with openings 5d and 5e for respectively communicating with the inlet port 15 and the outlet port 16 with the heat receiving chamber 13. Also, the partition plate 6 is provided with openings 6d and 6e for respectively communicating with the inlet port 15 and the outlet port 16 with the heat receiving chamber 14.

Heat exchanging fluid circulating through the heating circuit (not shown) of the vehicle heating system is introduced through the inlet port 15 and the openings 5d, 6d into the heat receiving chambers 13 and 14, and is discharged from the heat receiving chambers 13, 14 through the openings 5e, 6e and the outlet port 16 into the heating circuit. That is, the heat exchanging fluid introduced through the inlet port 15 into the heat receiving chamber 14 flows in a counterclockwise direction in FIG. 2, through substantially circular passages defined by the annular ridges 6c in the heat receiving chamber 14, and is finally discharged from the heat receiving chamber 14 through the outlet port 16.

A drive shaft 19, typically positioned in a substantially horizontal state, is supported by a bearing 17 inside the center boss la of the front housing body 1, and by a bearing 18 inside the cylindrical support part 5a of the front partition plate 5. The bearing 18 is axially fixedly positioned relative to the front partition plate 5 by a retaining ring 20, as well as relative to the drive shaft 19 by a retaining ring 21. The rear end of the drive shaft 19 is located in the interior space of the cylindrical support part 5a, which directly communicates with the heat generating chamber 12. The bearing 18 is a sealed rolling bearing provided with sealing plates held between an outer ring and an inner ring of the bearing. Consequently, the heat generating chamber 12, as well as the interior space of the cylindrical support part 5a, are sealed in a fluid-tight manner from the exterior of the heat generator.

A rotor element 22 in the shape of flat circular disk is arranged within the heat generating chamber 12 in such a manner as to be rotatable by the drive shaft 15 as described below. The rotor element 16 has axially opposed circular faces and a circumferential face, which form the outer faces of the rotor element 22. The outer faces of the rotor element 22 do not come into contact with the inner wall surfaces of the heat generating chamber 12 at any time, and thus define therebetween a relatively small gap for holding a viscous fluid described later. A plurality of thorough holes 22c are formed in the radially outer region of the rotor element 22 to increase the shearing stress applied to the viscous fluid by the rotor element 22 rotating in the heat generating chamber 12, and enable the viscous fluid to flow between the gap portions adjacent the opposed circular faces of the rotor element 22.

The rotor element 22 is provided in its center portion with an axle member which includes a front axle section 22a frontwardly projecting from the rotor element 22 toward the drive shaft 19 and a rear axle section 22b rearwardly projecting from the rotor element 22 away from the drive shaft 19. The front axle section 22a is coaxially coupled to the rear end of the drive shaft 19 through frictional coupling means as described below, and thereby the rotor element 22 is rotationally driven by the drive shaft 19 to rotate in the heat generating chamber 12 about the generally horizontal rotation axis of the drive shaft 19. In the illustrated embodiment, the axle member is a separate part adapted to be tightly fitted in the center hole of the rotor element 22, but it is also possible to integrally form the axle member with the rotor element 22.

A center recess 23 directly communicating with the heat generating chamber 12 is formed inside the center bulge of the rear partition plate 6 to accommodate the rear axle section 22b of the axle member of the rotor element 22. A bearing 24, in the form of a rolling bearing, is arranged in the center recess 23 to rotatably support the rear axle section 22b of the axle member in a cantilever fashion in the rear partition plate 6. The outer ring of the bearing 24 is loosely fitted in the center recess 23 in an axially movable manner, and the inner ring of the bearing 24 is press-fitted on the rear axle section 22b. As best seen in FIG. 3, the outer ring of the bearing 24 is positioned in the center recess 23 so as not to come into contact with the rear face of the rotor element 22.

A spring 25, in the form of a compression coil spring, is contained in the center recess 23 of the rear partition plate 6, and is arranged in a compressed state between the outer ring of the bearing 24 and the bottom wall of the center recess 23. As a result, the spring 25 forces the bearing 24 and the rotor element 22 together with the axle member toward the drive shaft 19 so that the front end of the front axle section 22a of the axle member is in contact with the rear end of the drive shaft 19. The spring 25 also serves as a means for locating the rotor element 22 at a proper position in the heat generating chamber 12 for maintaining the small gap between the inner wall surfaces of the heat generating chamber 12 and the outer faces of the rotor element 22.

A spring coil element 26, in the form of a clutch spring, is wound around a rear end portion of the drive shaft 19 and the front axle section 22a of the rotor element 22. The spring coil element 26 has a front end fixed to the drive shaft 19 and a free rear end, and the inner surface of the spring coil element 26 is frictionally in contact with the outer surfaces of both the drive shaft 19 and the front axle section 22a. The spring coil element 26 functions as a frictional coupling means for coupling the drive shaft 19 with the front axle section 22a, which can transmit the torque of the drive shaft 19 to the front axle section 22a and thus to the rotor element 22 when the drive shaft 19 rotates at a speed not higher than a predetermined level as described later, and also which can disconnect the torque transmission from the drive shaft 19 to the front axle section 22a when the drive shaft 19 rotates at a speed higher than the predetermined level.

A maximum torque $T_{max}$ which can be transmitted by the spring coil element 26 as a clutch spring is calculated by the following equation:

$$T_{max}=(EI\delta/R_s^2)[\exp.(2\pi\mu N)-1] \quad (1)$$

where $R_s$ is the radius of the front axle section 22a; $R_b$ is the inner diameter of the spring coil element 26; $\mu$ is the coefficient of friction between the front axle section 22a and the spring coil element 26; N is the number of effective coils of the spring coil element 26; E is the Young's modulus of the material of the spring coil element 26; I is the moment of inertia of area of the material forming the spring coil element 26; and $\delta=R_s-R_b$.

A theoretical fluidic friction torque T exerted due to the fluid friction of the viscous fluid on the rotor element 22 is calculated through the following equation:

$$T=[4\pi/(n+3)][(\omega^n r_0^{3+n})/h^n]/\mu_0 \quad (2)$$

where h is an axial dimension of the gap part on one side of the rotor element 22; $\omega$ is the angular velocity of the rotor element 22; $r_0$ is the radius of the rotor element 22; and $\mu_0$ and n are constants depending on the type of the viscous fluids (n=1 for Newtonian fluids, such as water, air, machine oil; $n\neq1$ for non-Newtonian fluids such as silicone oil; $0.2\leqq n<1$ especially for silicone oil). The lower values of n designate the higher viscosity of the viscous fluids. As is obvious from the equation (2), the torque T increases with the increase of the angular velocity $\omega$ (or the rotating speed) of the rotor element 22.

The spring coil element 26 in the first embodiment is designed so that the maximum transmittable torque $T_{max}$ thereof is larger than a low-speed friction torque $T_L$ exerted by the viscous fluid on the rotor element 22 when the rotor element 22 rotates at a relatively low speed sufficient for obtaining the minimum heat generation usable in an external heating system, and is smaller than a high-speed frictional torque $T_H$ exerted by the viscous fluid on the rotor element 22 when the rotor element 22 rotates at a relatively high, predetermined thermal limit speed. The "predetermined thermal limit speed" of the rotor element 22 means in this specification such a threshold of rotation speed that the viscous fluid generates excessive heat when the rotation speed of the rotor element 22 exceeds the threshold, which probably accelerates the thermal degradation of the viscous fluid and thus the reduction of the viscosity of the viscous fluid, under the shearing stress applied by the rotating rotor element 22.

The predetermined thermal limit speed depends on, e.g., the dimension of the gap between the outer faces of the rotor element 22 and the wall surfaces of the heat generating chamber 12, the coefficient of viscosity (or the frictional drag) of the viscous fluid held in the gap, the outer diameter of the rotor element 22, the area of the shearing surface (or a surface which contributes to the shearing action applied to the viscous fluid in cooperation with the wall surfaces of the heat generating chamber 12) of the rotor element 22, etc. In the preferred embodiment, the spring coil element 26 is designed so that the maximum torque $T_{max}$ which can be transmitted by the spring coil element 26 to the front axle section 22a is approximately equal to the friction torque $T_H$ exerted by the viscous fluid on the rotor element 22 when the rotor element 22 rotates at the predetermined thermal limit speed.

An additional chamber 27 is defined between the rear partition plate 6 and the rear housing body 2 radially inside the cylindrical part 6a and the support part 2a, i.e., radially inside the rear heat receiving chamber 14. The additional chamber 27 communicates with the heat generating chamber 12 through holes 6f and 6g formed in the annular part of the rear partition plate 6 near the center bulge thereof.

A predetermined amount of the viscous fluid such as silicone oil, is accommodated in both the heat generating chamber 12 and the additional chamber 27. The through hole 6g opens to a lower portion of the additional chamber 27, and the through hole 6f opens to an upper portion of the additional chamber 27. The predetermined amount of the viscous fluid is selected so that, when the rotor element does not rotate, the fluid level of the viscous fluid in the additional chamber 27 is maintained between the through holes 6f and 6g. When the rotor element 22 rotates together with the drive shaft 19, the small gap between the inner wall surfaces of the heat generating chamber 12 and the outer faces of the rotor element 22 is substantially entirely filled with the viscous fluid such as silicone oil due to surface tension and the Weissenberg effect.

The drive shaft 19 is connected through an electromagnetic clutch device 28 disposed around the center boss 1a of the front housing body 1. The electromagnetic clutch device 28 includes a pulley 30 supported for rotation by angular contact rolling bearings 29 on the center bore 1a, a support plate 31 fixedly mounted on the front end of the drive shaft 19 for rotation together with the drive shaft 19, and a clutch disk 32 axially shiftably supported around the support plate 31 by a circular plate spring 33 for rotation together with the support plate 31. The plate spring 33 is fixed at the radially center region thereof to the front side of the support plate 31, and at the outer peripheral region thereof to the clutch disk 32 by, e.g., rivets. The operating surface of the clutch disk 32 confronts the front surface 30a of the pulley 30, which forms a counterpart operating surface of the clutch device 28.

The pulley 30 is operatively connected by a belt (not shown) to a vehicle engine (not shown) as a drive source. A cylindrical solenoid 34 is supported on the front housing body 1 so as to be arranged in an annular recess formed in the rear side of the pulley 30. The solenoid 34 exerts an electromagnetic force through the front surface 30a of the pulley 30 on the clutch disk 32 to attract the disk 32 toward the surface 30a.

The viscous fluid type heat generator thus constructed is incorporated into the heating circuit of the vehicle heating system. When the engine operates, the output torque of the engine is transmitted through the belt to the pulley 30. When the solenoid 34 of the electromagnetic clutch device 28 is energized during the time that the pulley 30 is driven for rotation, the clutch disk 32 is attracted and joined to the front surface 30a of the pulley 30, against the frontward biasing force applied by the plate spring 33, by the electromagnetic force of the solenoid 34. The rotation or torque of the pulley 30 is transmitted through the clutch disk 32 and support plate 31 to the drive shaft 19. The rotating speed of the drive shaft 19 varies according to the change of the rotating speed of the output of the engine, i.e., the engine speed.

The rotation or torque of the drive shaft 19 is frictionally transmitted to the rotor element 22 by the spring coil element 26 as frictional coupling means, which is fixed at the front end thereof to the drive shaft 19 and is frictionally tightly fitted at the rear end thereof the front axle section 22a, as previously described. The rotating rotor element 22 applies a shearing stress to the viscous fluid such as silicon oil held in the small gap between the inner wall surfaces of the heat generating chamber 12 and the outer faces of the rotor element 22, and consequently the viscous fluid generates heat. The heat thus generated is transferred to the heat exchanging fluid flowing through the heat receiving chambers 13 and 14, and is carried by the heat exchanging fluid circulating through the heating circuit (not shown) of the vehicle heating system to heat, e.g., the passenger compartment.

The spring coil element 26 rotating together with the drive shaft 19 transmits the torque of the drive shaft 19 to the front axle section 22a by kinetic friction between the inner cylindrical surface of the spring coil element 26 and the outer circumferential surface of the front axle section 22a. As is obvious from the above equation (1), the maximum torque $T_{max}$ which can be transmitted by the spring coil element depends on the number of coils and dimension of the spring coil element, but is independent of the rotating speed of the drive shaft. Also, as is obvious from the above equation (2), the friction torque T exerted by the viscous fluid on the rotating rotor element increases with the increase of the rotating speed of the rotor element 22. Further, as previously discussed, the spring coil element 26 is designed so that the maximum transmittable torque $T_{max}$ thereof is larger than the friction torque $T_L$ exerted by the viscous fluid on the rotor element 22 when the rotor element 22 rotates at the lower speed, and is smaller than the friction torque $T_h$ exerted by the viscous fluid on the rotor element 22 when the rotor element 22 rotates at the higher predetermined thermal limit speed.

Therefore, the rotating speed of the rotor element 22 increases as the rotating speed of the drive shaft increases, until the rotating speed of the drive shaft 19 with the spring coil element 26 exceeds a predetermined level which is associated with the maximum transmittable torque $T_{max}$ of the spring coil element 26. Once the rotating speed of the drive shaft 19 exceeds the predetermined level, i.e., the fluidic friction torque T exerted by the viscous fluid on the rotor element 22 rotating together with the drive shaft 19 exceeds the maximum transmittable torque $T_{max}$, the spring coil element 26 begins to frictionally slide on the outer circumferential surface of the front axle section 22a. Consequently, when the rotating speed of the drive shaft 19 exceeds the predetermined level, the rotor element 22 tends to rotate at a substantially constant rotating speed lower than the rotating speed of the drive shaft 19, regardless of the change of rotating speed of the drive shaft 19 and spring coil element 26, in the state that the dynamic friction torque applied by the spring coil element 26 on the front axle section 22a is balanced with the fluidic friction torque exerted by the viscous fluid on the rotor element 22.

In this manner, the viscous fluid type heat generator of the first embodiment can prevent the heat generation by the shearing action of the rotor element 22 from increasing up to the level at which the thermal degradation of the viscous fluid such as silicone oil is accelerated when the engine operates at a higher speed than a predetermined engine speed, so as to prevent the temperature of the viscous fluid from exceeding the thermal limit temperature thereof, and thus to prevent the thermal degradation of the viscous fluid.

Again, in the viscous fluid type heat generator of the first embodiment, the spring coil element 26 slides on the outer circumferential surface of the front axle section 22a when the drive shaft 19 rotates at a speed exceeding the predetermined level, and the rotor element 22 rotates at a substantially constant speed under the above-mentioned torque-balanced state, even if the rotating speed of the drive shaft further increases in the extent beyond the predetermined level, so that a substantially constant heat generating rate is maintained. In this connection, since the electromagnetic clutch device 28 need not be disengaged to avoid the excessive heat generation, the rotor element 22 can be driven for rotation at a substantially constant speed and the viscous fluid can continue to generate heat in a substantially constant rate, even when the engine operates at such a high engine speed for a long time that otherwise could cause the excessive heat generation and the thermal degradation of the viscous fluid. Therefore, it is possible to eliminate the idling of the drive shaft 19 and effectively use the torque of the drive shaft 19 for the rotation of the rotor element 22 and thus for the heat generation.

If the spring coil element 26 is advantageously designed so that the maximum torque $T_{max}$ thereof transmittable to the front axle section 22*a* is approximately equal to the friction torque $T_H$ exerted by the viscous fluid on the rotor element 22 rotating at the predetermined thermal limit speed, the torque of the drive shaft 19 can be most effectively used for the heat generation of the viscous fluid without causing the excessive heat generation.

The other structural advantages of the viscous fluid type heat generator of the first embodiment are as follows:

i) The rear axle section 22*b* of the axle member of the rotor element 22 is supported in a cantilever fashion on the rear partition plate 6 of the rear housing assembly 9. This structure serves to reduce the space required in the housing assembly for rotatably supporting the rotor element 22 independently of the drive shaft 19. However, the present invention is not restricted to such a structure but may be embodied by using two or more bearings for rotatably supporting both the front and rear axle sections 22*a*, 22*b*.

ii) The rotor element 22 is properly positioned in the heat generating chamber 12 by the spring 25 as a locating means to maintain the small gap between the inner surfaces of the heat generating chamber 12 and the outer faces of the rotor element 22. This structure serves to establish the stable rotation of the rotor element 22.

iii) The bearing 24 is axially movably fitted in the center recess 23 of the rear partition plate 6 and is forced by the spring 25 so that the front axle section 22*a* of the axle member, on which the bearing 24 is secured, of the rotor element 22 is in contact with the rear end of the drive shaft 19, whereby the rotor element 22 is axially properly positioned. Therefore, the rotor element 22 can be automatically positioned by locating the drive shaft 19 at a predetermined position, which facilitates an assembling operability. The loose-fit structure of the bearing 24 in the recess 23 serves to prevent the rear partition plate 6 from being deformed even if it has a relatively low strength when the bearing 24 is fitted in the recess 23.

iv) When the rotor element 22 rotates, the viscous fluid circulates from the heat generating chamber 12 via the through hole 6*f* into the additional chamber 27 and from the additional chamber 27 via the through hole 6*g* into the heat generating chamber 12. Thus, the same viscous fluid is not held at a high temperature for a long time in the heat generating chamber 12, whereby the life of the viscous fluid is extended.

v) The heat generating chamber 12 is arranged between the front and rear heat receiving chambers 13, 14, whereby most of heat generated in the heat generating chamber 12 is transferred through the front and rear partition plates 5 and 6 to the heat exchanging fluid flowing through the heat receiving chambers 13, 14 and is effectively used for the external heating circuit. However, the present invention is not restricted to such a structure but may be embodied by using one heat receiving chamber arranged at only one side of the heat generating chamber.

vi) The partition plates 5, 6 are made of a material having a high thermal conductivity, such as aluminum or an aluminum alloy, whereby the heat generated in the heat generating chamber 12 can be efficiently transferred to the heat exchanging fluid flowing through the heat receiving chambers 13, 14.

vii) The heat exchanging fluid received through the inlet port 15 into the heat receiving chambers 13, 14 flows along circular passages defined by the annular ridges 5*c*, 6*c* in the heat receiving chambers 13, 14, whereby the heat exchanging fluid smoothly flows without being disturbed. Therefore, the heat generated in the heat generating chamber 12 can be efficiently transferred from the viscous fluid held in the heat generating chamber 12 through the partition plates 5, 6 to the heat exchanging fluid flowing through the heat receiving chambers 13, 14. The annular ridges 5*c*, 6*c* increase the areas of the surfaces of the partition plates 5, 6 to be in contact with the heat exchanging fluid, which improves the heat transfer efficiency.

FIGS. 4A to 8 show a second embodiment of a viscous fluid type heat generator according to the present invention. The viscous fluid type heat generator of the second embodiment is different from that of the first embodiment only in the frictional coupling means, and is substantially the same, in other parts, as the first embodiment. Therefore, the other parts except for the frictional coupling means are not described in detail below.

Figure 4A:
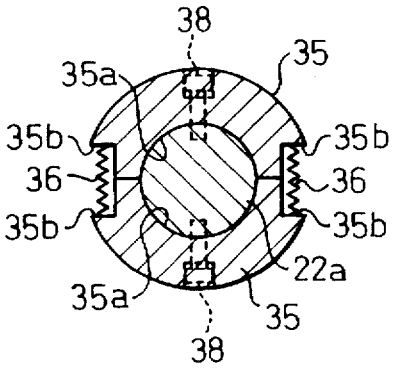
FIG. 4A is a sectional view of a second embodiment of a viscous fluid type heat generator according to the present invention, showing frictional coupling means used therein in a state of being in contact with an axle member.
Figure 4B:
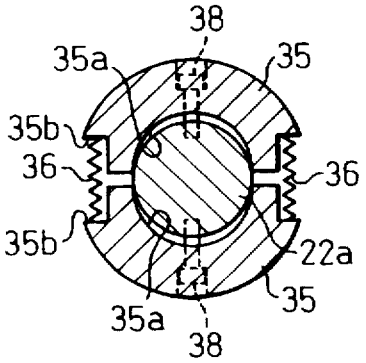
FIG. 4B is a sectional view of the second embodiment, showing the frictional coupling means in a state of being separated from the axle member.
Figure 5:
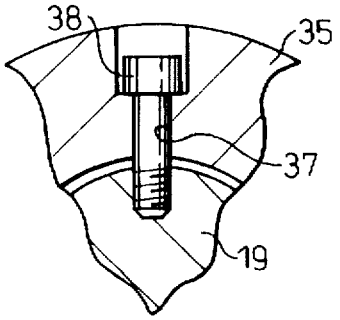
FIG. 5 is a fragmentary sectional view of one of the frictional coupling means of FIG. 4B, showing a support structure for supporting the coupling means on a drive shaft.
Figure 6:
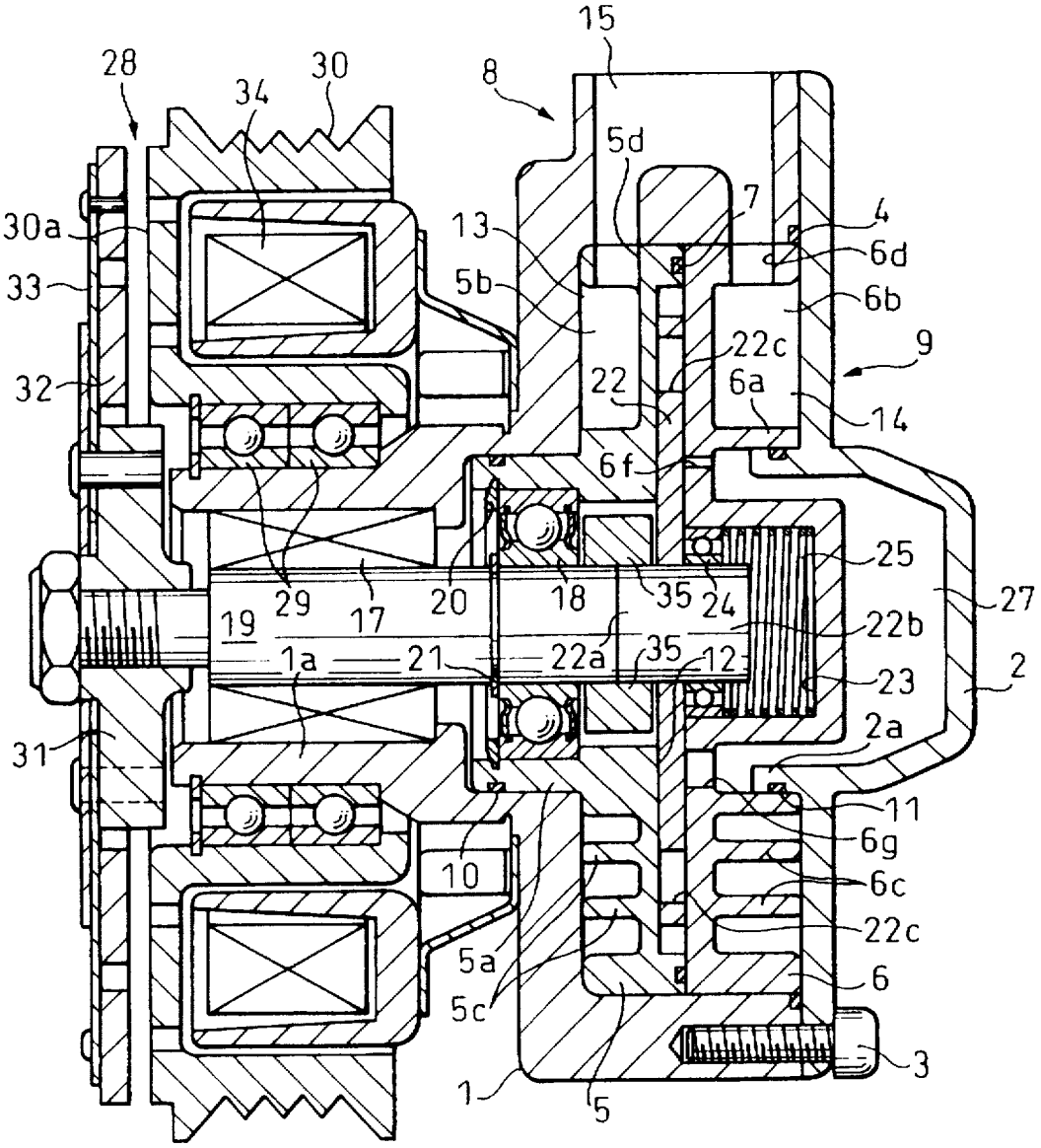
FIG. 6 is a longitudinal sectional view, similar to FIG. 1, of the second embodiment of the viscous fluid type heat generator.
Figure 7:
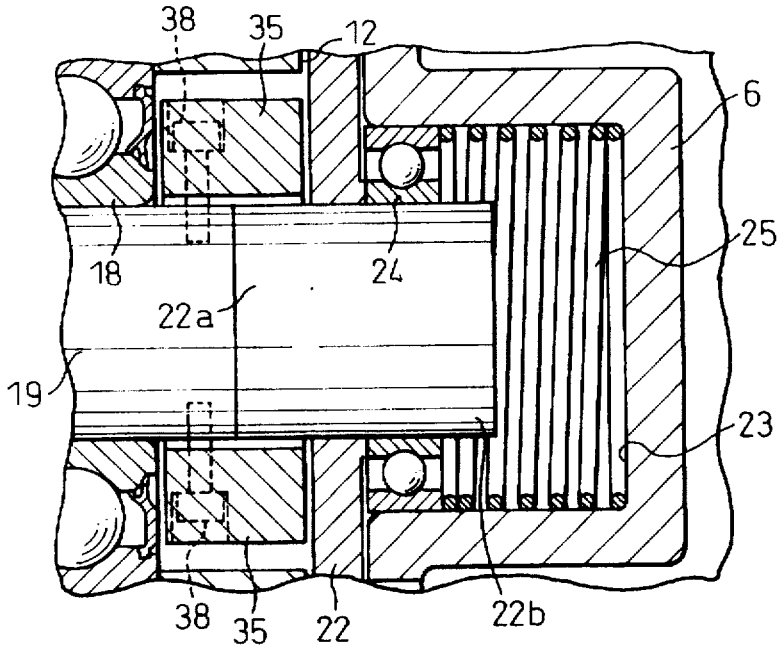
FIG. 7 is an enlarged fragmentary longitudinal sectional view showing the frictional coupling means of FIG. 4B in a state of being separated from the drive shaft.

Referring to FIGS. 4A and 4B, the frictional coupling means in the second embodiment includes a pair of frictional coupling members 35 each of which is shaped as a substantially semicircular cylinder half, and extension springs 36 arranged between the frictional coupling members 35 to apply the latter with a biasing force toward each other. As shown in FIGS. 6 and 7, each frictional coupling member 35 is mounted on both the rear end of the drive shaft 19 and the front axle section 22*a* of the axle member of the rotor element 22 at a position not in contact with both the bearing 18 and the rotor element 22.

As shown in FIGS. 4A and 4B, each frictional coupling member 35 has a cylindrical inner surface 35*a* of a curvature equal to that of the outer circumferential surfaces of the drive shaft 19 and front axle section 22*a*. The frictional coupling members 35 are pulled toward each other by the extension springs 36 disposed respectively in radially opposed recesses 35*b* formed at the radially opposed outside corners of both the frictional coupling members 35. Each frictional coupling member 35 is provided with a stepped through hole 37 (see FIG. 5), and a hexagon socket head cap screw 38 is inserted into the stepped through hole 37 and screwed in a threaded hole formed in the drive shaft 19 to support the frictional coupling member 35 on the drive shaft 19. Thus, the frictional coupling members 35 can rotate together with the drive shaft 19.

Each frictional coupling member 35 is radially movable along the body of the hexagonal socket head cap screw 38 relative to both the drive shaft 19 and the front axle section 22*a*. The head of the hexagonal socket head cap screw 38 engages with the shoulder of the stepped thorough hole 37 to restrict the radially outward movement of the frictional coupling member 35 relative to the drive shaft 19, so that the frictional coupling member 35 does not interfere with the front partition plate 5 at a radially outermost position of the frictional coupling member 35.

The extension springs 36 are biasing means for biasing the frictional coupling members 35 toward each other to bring the inner surfaces 35*a* of the frictional coupling members 35 into contact with the outer circumferential surfaces of the drive shaft 19 and the front axle section 22*a* and to maintain a mutually contacted state. The extension springs 36 are designed to be capable of maintaining the inner surfaces 35*a* of the frictional coupling members 35 in contact with the outer circumferential surfaces of the drive shaft 19 and the front axle section 22*a* until the rotating speed of the drive shaft 19 exceeds a predetermined level which is associated with the maximum transmittable torque $T_{max}$ of the frictional coupling members 35, in the same manner as the spring coil element 26 of the first embodiment.

On the other hand, the cylindrical inner surfaces 35*a* of the frictional coupling members 35 and the outer circumferential surface of the front axle section 22a, coming into contact with the inner surfaces 35a, are formed so that the kinetic friction between the inner surfaces 35a of the coupling members 35 and the outer surface of the front axle section 22a prevents the frictional coupling members 35 from rotationally sliding on the front axle section 22a until the rotating speed of the drive shaft 19 exceeds the predetermined level. The coefficient of friction between the inner surface 35a of each frictional coupling member 35 and the outer surface of the front axle section 22a is adjusted by, e.g., variably finishing the inner surface 35a of the frictional coupling member 35 and the outer surface of the front axle section 22a, or forming the frictional coupling member 35 of an appropriate frictional material.

In the viscous fluid type heat generator of the second embodiment, the rotation of the drive shaft 19 is transmitted by the frictional coupling members 35 to the front axle section 22a of the axle member of the rotor element 22. The frictional coupling members 35 are maintained in a state, as shown in FIGS. 4A and 6, where the cylindrical inner surfaces 35a thereof are in contact with the outer circumferential surfaces of the drive shaft 19 and front axle section 22a by the tension force of the extension springs 36, until the rotating speed of the drive shaft 19 exceeds the predetermined level mentioned above. In this state, the rotation of the drive shaft 19 is transmitted to the front axle section 22a by the friction force between the inner surfaces 35a of the coupling members 35 and the outer surface of the section 22a.

When the drive shaft 19 rotates with the frictional coupling members 35, a centrifugal force acts on each coupling member 35 to bias the coupling member 35 in a radially outward direction from the front axle section 22a against the tension force of the extension springs 36. Therefore, when the drive shaft 19 rotates at a rotating speed exceeding the predetermined level, the frictional coupling members 35 are fully separated from the drive shaft 19 and the front axle section 22a, as shown in FIGS. 4B and 7, so that the torque of the drive shaft 19 is not transmitted to the front axle section 22a and thus to the rotor element 22.

Therefore, the rotating speed of the rotor element 22 increases as the rotating speed of the drive shaft increases, until the rotating speed of the drive shaft 19 with the coupling members 35 exceeds the predetermined level. Once the rotating speed of the drive shaft 19 exceeds the predetermined level, i.e., the fluidic friction torque T exerted by the viscous fluid on the rotor element 22 rotating together with the drive shaft 19 exceeds the maximum transmittable torque $T_{max}$ of the coupling members 35, the coupling members 35 are unable to transmit the torque of the drive shaft 19 to the front axle section 22a. As a result, the rotor element 22 inertly rotates while being applied with a fluidic friction torque by the viscous fluid. Accordingly, it is possible to prevent the heat generation by the shearing action of the rotor element 22 from increasing up to the level at which the thermal degradation of the viscous fluid such as a silicone oil is accelerated.

The frictional coupling members 35 and the extension springs 36 are designed so that the maximum transmittable torque $T_{max}$ of the coupling members 35 is larger than the friction torque $T_L$ exerted by the viscous fluid when the rotor element 22 rotates at the lower speed, and is smaller than the friction torque $T_H$ exerted by the viscous fluid when the rotor element 22 rotates at the higher predetermined thermal limit speed, in the same manner as the spring coil element 26 of the first embodiment. It is also advantageous that the maximum torque $T_{max}$ of the coupling members 35 transmittable to the front axle section 22a is approximately equal to the friction torque $T_H$ exerted by the viscous fluid on the rotor element 22 rotating at the predetermined thermal limit speed.

When the rotating speed of the drive shaft 19 drops to or below the predetermined level, the frictional coupling members 35 are brought into contact with the drive shaft 19 and the front axle section 22a under the tension force of the extension springs 36, so that the rotation of the drive shaft 19 is transmitted to the front axle section 22a and thus to the rotor element 22.

The viscous fluid type heat generator of the second embodiment possesses substantially the same effects and structural advantages as those in the first embodiment, except for those regarding the structure of the spring coil element 26, and also has the advantages regarding the structure of the frictional coupling members 35 as follows:

i) Once the rotating speed of the drive shaft 19 exceeds the predetermined level, the frictional coupling members 35 are fully disengaged from the front axle section 22a of the axle member of the rotor element 22. Thus, in this condition, the coupling members 35 do not rotationally slide on the outer circumferential surface of the front axle section 22a. Therefore, it is possible to prevent the engine from being subjected to an additional and undesirable load, and to extend the respective lives of the front axle section 22a and the frictional coupling members 35.

ii) The head of the hexagonal socket head cap screw 38 engages with the shoulder of the stepped through hole 37 to limit the radially outward movement of the frictional coupling member 35 relative to the drive shaft 19, so that the frictional coupling member 35 may not interfere with the front partition plate 5 when the frictional coupling member 35 is at a radially outermost position. Thus, it is possible to avoid applying the engine with an additional and undesirable load due to the contact of the coupling members 35 with the inner wall surface of the front partition plate 5. The extension springs 36 need not have a function to prevent the contact of the coupling members 35 with the front partition plate 5, which may extend the selectable range of the biasing force required by each extension spring 37.

It should be understood that the present invention is not restricted to the above embodiments, and includes various changes and modifications as illustrated in the drawings as set forth below.

Figure 8:
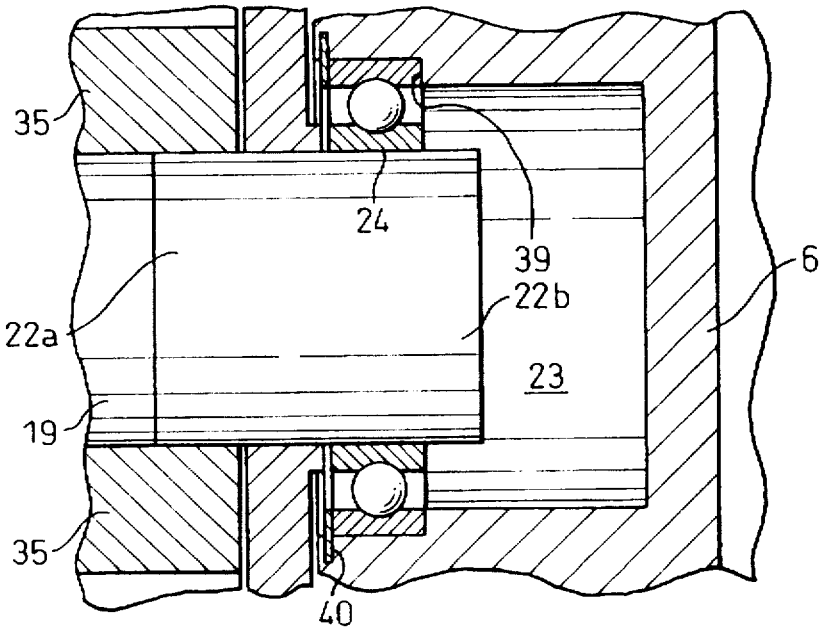
FIG. 8 is an enlarged fragmentary longitudinal sectional view of a modification of the second embodiment.
Figure 9A:
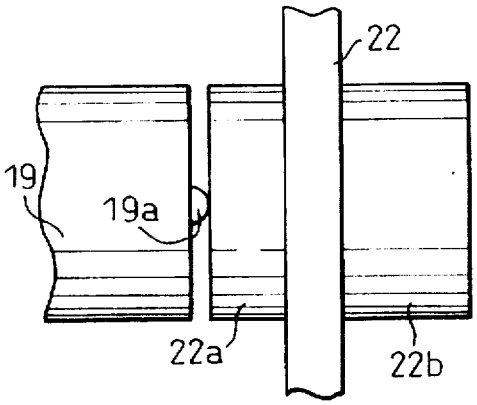
FIG. 9A is a fragmentary schematic front view of another modification, showing a coupling portion of a drive shaft with an axle member.

As shown in FIG. 8, the bearing 24 for rotationally supporting the rear axle section 22b of the axle member of the rotor element 22 may be fixedly arranged in the center recess 23 of the rear partition plate 6, by a shoulder 39 formed in the rear partition plate 6 and a retaining ring 40 secured to the rear partition plate 6, both being abutted to the opposed axial ends of the bearing 24, and thus forming locating means. In this modification, the bearing 24 and thus the rotor element 22 are properly positioned by the shoulder 39 and the retaining ring 40, irrespective of whether the drive shaft 19 is in contact with the front axle section 22a. Therefore, it is possible to mount the drive shaft 19 in a manner as to be not in contact with the front axle section 22a, and thus any frictional resistance caused between the drive shaft 19 and the front axle section 22a is eliminated, which would otherwise be caused when the frictional coupling means cannot accurately transmit the rotation of the drive shaft 19 to the front axle section 22a. This reduces the power loss in the torque transmitting system of the viscous fluid type heat generator.

Where that the drive shaft 19 acts in cooperation with the spring 25 to locate the rotor element 22 at a proper position, the end face of the drive shaft 19 confronting the end face of the front axle section 22*a* may be provided with a central protrusion 19*a* which comes into contact with the end face of the front axle section 22*a* under the biasing force of the spring 25, as shown in FIG. 9A. It is also possible to provide such a central protrusion on at least one of the end faces of the drive shaft 19 and the front axle section 22*a*. In this modification, the area of contact between the drive shaft 19 and the front axle section 22*a* is minimized, and thus only a small frictional resistance acts against the drive shaft 19 rotating relative to the front axle section 22*a*. This also reduces the power loss in the torque transmitting system of the viscous fluid type heat generator.

In the second embodiment, two frictional coupling members 35 may be replaced with three (see FIG. 9B) or more frictional coupling members 35' formed by splitting a cylindrical part into three or more equal segments. That is, in FIG. 9B, each of the three frictional coupling members 35' is provided with a pair of axially extending end faces defining an angle of about 120 degrees therebetween. Extension springs 16 are respectively provided between the adjacent frictional coupling members 35'. In this modification, the rotation of the drive shaft 19 is also transmitted by the frictional coupling members 35' to the front axle section 22*a* when the rotating speed of the drive shaft 19 is not higher than the predetermined level.

In the case of using the two frictional coupling members 35, the radially opposed edges of the cylindrical inner surface 35*a* of each frictional coupling member 35 move tangentially relative to the outer circumferential surfaces of the drive shaft 19 and front axle section 22*a*, as shown in FIG. 4B. Thus, it is necessary to precisely arrange and form the stepped through hole 37 and the hexagonal socket head cap screw 38 accurately along the radial lines of the drive shaft 19 and front axle section 22*a*, to eliminate the risk of contact between one of the opposed edges of the inner surface 35*a* and the outer surface of the front axle section 22*a*, even when the frictional coupling member 35 is radially outwardly shifted in a slight distance to release the front axle section 22*a*. On the other hand, the above modification using the three or more frictional coupling members 35' may minimize such a risk without precisely forming the hole 37 and/or the screw 38.

Figure 9B:
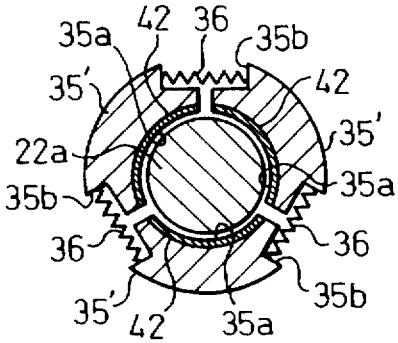
FIG. 9B is a sectional view of the further modification, showing frictional coupling means in a state of being separated from an axle member.

As also shown in FIG. 9B, at least one of the cylindrical inner surface of the frictional coupling member 35 and the outer circumferential surface of the front axle section 22*a* may be provided with a friction increasing means such as a frictional layer 42 having a highly frictional property. In this modification, the frictional coupling members 35 may not rotationally slide on the front axle section 22*a* until the rotating speed of the drive shaft 19 exceeds the predetermined level so that the torque of the drive shaft 19, under the maximum transmittable torque $T_{max}$ of the frictional coupling members 35, can be surely transmitted to the rotor element 22.

Figure 10:
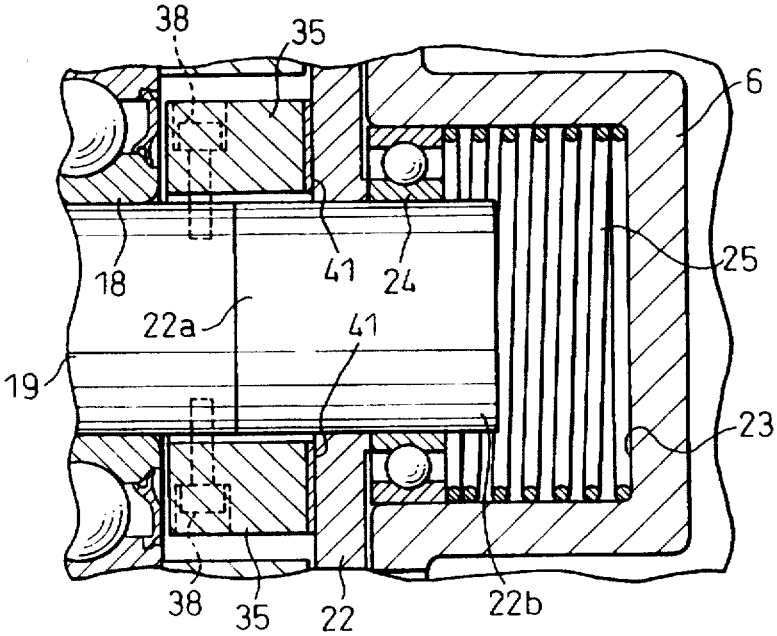
FIG. 10 is an enlarged fragmentary longitudinal sectional view of a yet further modification, showing frictional coupling means used therein.

As shown in FIG. 10, each frictional coupling member 35 may include a rear end face arranged to be in contact with the front face of the rotor element 22. In this case, the friction force or torque between the rear faces of the coupling members 35 and the front face of the rotor element 22 is determined so that the torque of the drive shaft 19 is partially transmitted to the rotor element 22 by the frictional sliding of the coupling members 35 on the rotor element 22 when the coupling members 35 are disengaged from the front axle section 22*a*. This may be established by, for example, finishing the rear faces of the coupling members 35 and/or the front face of the rotor element 22 to the desired surface roughnesses, by forming the coupling members 35 of a material having an appropriate frictional property, or by attaching a friction plate 41 having an appropriate frictional property to the rear face of each coupling member 35.

In this modification, it is a further advantage that the rear face of each coupling member 35 and the confronting front face of the rotor element 22 is inclined in the same direction so that the rear face of the coupling member 35 comes into contact with the front face of the rotor element 22 only when the coupling member 35 is separated radially outward from the front axle section 22*a*.

According to this modification, even when the rotating speed of the drive shaft exceeds the predetermined level and the frictional coupling members 35 are disengaged from the front axle section 22*a*, the rear faces of the frictional coupling members 35 are in contact with the front face of the rotor element 22. Thus, the rotor element 22 can be driven for rotation in the state that the dynamic friction torque applied by the rear faces of the coupling members 35 on the front face of the rotor element 22 is balanced with the fluidic friction torque exerted by the viscous fluid on the rotor element 22.

Since the dynamic friction torque by the rear faces of the coupling members 35 is smaller than the fluidic friction torque $T_H$ by the viscous fluid when the rotor element 22 rotates at the predetermined thermal limit speed, the rotor element 22 is not driven for rotation at a rotating speed higher than the predetermined thermal limit speed and thus the excessive heat generation can be avoided. Therefore, similar to the first embodiment, the viscous fluid can continue to generate heat without causing the excessive heat generation and the thermal degradation of the viscous fluid, even when the engine operates at such a high engine speed for a long time that otherwise could cause such thermal problems of the viscous fluid. Also, it is possible to eliminate the idling of the drive shaft 19 and effectively use the torque of the drive shaft 19 for the rotation of the rotor element 22 and thus for the heat generation.

The examples of the other modifications not illustrated are as follows:

It is possible to use the other guide structures for guiding and supporting each frictional coupling member 35 on the drive shaft 19 and the other limit means for limiting the radial movement of the coupling member 35, instead of the stepped through hole 37 and the hexagonal socket head cap screw 38.

The heat receiving chambers 13 and 14 may be connected by a passage to enable the heat exchanging fluid introduced through the inlet port 15 into one heat receiving chamber 13 or 14 to flow into the other heat receiving chamber 13 or 14 through the passage and is discharged therefrom through the outlet port 16 into the external heating circuit.

The electromagnetic clutch device 28 interlocking the pulley 30 and the drive shaft 19 may be omitted, and instead, the rotation of the pulley 30 may be directly transmitted to the drive shaft.

The annular ridges 5*c* and 6*c* of the partition plates 5 and 6 may be formed so as not to be in contact with the housing body 1 and 2, respectively, or may be omitted.

The front and rear faces of the rotor element 22 may be provided in the radially outer regions thereof with grooves or ridges, and the inner wall surfaces of the partition plates 5 and 6 may be provided with corresponding grooves or ridges for forming a labyrinth-shaped small gap for holding the viscous fluid. Such a labyrinth gap may improve the efficiency of heat generation of the viscous fluid due to the shearing action of the rotating rotor element 22. It is also possible to provide such a labyrinth gap only on the front or rear face of the rotor element 22.

The disk shaped rotor element may be replaced by a cylindrical rotor element in which the outer circumferential surface thereof mainly serves to apply the shearing stress to the viscous fluid for generating heat.

It should be understood that the term "viscous fluid" used in this specification means any fluidic medium capable of generating heat when being subjected to the shearing action of the rotor element, and does not mean only a highly viscous liquid or a semifluid, such as a silicone oil.

Although the invention has been described in its preferred form with a certain degree of particularity, obviously many changes and variations are possible therein. It is therefore to be understood that the present invention may be practiced otherwise than as specifically described herein without departing from the scope and spirit thereof.

We claim:

1. A viscous fluid type heat generator comprising:

a housing assembly defining therein a heat generating chamber in which heat is generated, and a heat receiving chamber arranged adjacent to said heat generating chamber for permitting a heat exchanging fluid to circulate through said heat receiving chamber to thereby receive heat from said heat generating chamber, said heat generating chamber having inner wall surfaces thereof;

a drive shaft supported by said housing assembly to be rotatable about an axis of rotation of said drive shaft, said drive shaft being operationally connected to an external rotation-drive source;

a rotor element supported by said housing assembly separately from said drive shaft to be rotationally driven by said drive shaft for rotation within said heat generating chamber, said rotor element having outer faces confronting said inner wall surfaces of said heat generating chamber via a predetermined gap defined therebetween;

a viscous fluid, held in said gap defined between said inner wall surfaces of said heat generating chamber of said housing assembly and said outer faces of said rotor element, for heat generation under a shearing stress applied by the rotation of said rotor element; and frictional coupling means for frictionally coupling said drive shaft with said rotor element and for mechanically transmitting a rotation of said drive shaft to said rotor element to permit said rotor element to rotate in said heat generating chamber at a speed not higher than a predetermined thermal limit speed.

2. The viscous fluid type heat generator of claim 1, wherein said frictional coupling means permits said rotor element to rotate together with said drive shaft at substantially a rotation speed of said drive shaft when a fluidic friction torque exerted by said viscous fluid onto said rotor element is not larger than a predetermined maximum torque transmittable by said frictional coupling means to said rotor element.

3. The viscous fluid type heat generator of claim 1, wherein said frictional coupling means permits said rotor element to rotate at a speed lower than a rotation speed of said drive shaft in a state where said frictional coupling means frictionally slide on said rotor element when a fluidic friction torque exerted by said viscous fluid onto said rotor element exceeds a predetermined maximum torque transmittable by said frictional coupling means to said rotor element.

4. The viscous fluid type heat generator of claim 2, wherein said predetermined maximum torque substantially corresponds to a fluidic friction torque exerted by said viscous fluid onto said rotor element rotating at said predetermined thermal limit speed.

5. The viscous fluid type heat generator of claim 1, wherein said rotor element is provided with an axle member axially oppositely extending from said rotor element along a rotation axis of said rotor element, said axle member being coaxially arranged with said drive shaft.

6. The viscous fluid type heat generator of claim 5, wherein said frictional coupling means comprises a spring coil element having a first end fixed to said drive shaft and an opposed second end frictionally engaged with said axle member with a radially inner surface of said spring coil element being in close contact with the outer circumferential surface of said axle member.

7. The viscous fluid type heat generator of claim 6, wherein said spring coil element permits said rotor element to rotate together with said drive shaft at substantially a rotation speed of said drive shaft when a fluidic friction torque exerted by said viscous fluid onto said rotor element is not larger than a predetermined maximum torque transmittable by said spring coil element to said axle member.

8. The viscous fluid type heat generator of claim 6, wherein said spring coil element permits said rotor element to rotate at a speed lower than a rotation speed of said drive shaft in a state where said spring coil element frictionally slides on said axle member when a fluidic friction torque exerted by said viscous fluid onto said rotor element exceeds a predetermined maximum torque transmittable by said spring coil element to said axle member.

9. The viscous fluid type heat generator of claim 7, wherein said predetermined maximum torque substantially corresponds to a fluidic friction torque exerted by said viscous fluid onto said rotor element rotating at said predetermined thermal limit speed.

10. The viscous fluid type heat generator of claim 5, wherein said frictional coupling means comprises a plurality of frictional coupling members, each of which is supported on said drive shaft for radial movement and has a radially inner surface capable of coming into contact with an outer circumferential surface of said axle member, and biasing means for biasing said frictional coupling members to bring said inner surface of each frictional coupling member into contact with said outer circumferential surface of said axle member.

11. The viscous fluid type heat generator of claim 10, wherein said frictional coupling members permit said rotor element to rotate together with said drive shaft at substantially a rotation speed of said drive shaft when a fluidic friction torque exerted by said viscous fluid onto said rotor element is not larger than a predetermined maximum torque transmittable by said frictional coupling members to said axle member.

12. The viscous fluid type heat generator of claim 11, further comprising friction enhancing means provided on at least one of said radially inner surface of each frictional coupling member and said outer circumferential surface of said axle member.

13. The viscous fluid type heat generator of claim 10, wherein said frictional coupling members permit said rotor element to rotate at a speed lower than a rotation speed of said drive shaft in a state where said frictional coupling members frictionally slide on said axle member when a fluidic friction torque exerted by said viscous fluid onto said rotor element exceeds a predetermined maximum torque transmittable by said frictional coupling members to said axle member.

14. The viscous fluid type heat generator of claim 11, wherein said predetermined maximum torque substantially corresponds to a fluidic friction torque exerted by said viscous fluid onto said rotor element rotating at said predetermined thermal limit speed.

15. The viscous fluid type heat generator of claim 10, wherein said biasing means is a spring capable of maintaining said frictional coupling members in contact with said outer circumferential surface of said axle member when said drive shaft rotates at a speed not higher than a predetermined level associated with said predetermined maximum torque.

16. The viscous fluid type heat generator of claim 15, wherein said biasing means includes a plurality of extension springs arranged between mutually adjacent said frictional coupling members.

17. The viscous fluid type heat generator of claim 5, wherein said axle member includes a section extending away from said drive shaft, said section being rotationally supported in a cantilever fashion by a bearing mounted on said housing assembly.

18. The viscous fluid type heat generator of claim 17, wherein said bearing is mounted on said housing assembly in an axially shiftable manner, and wherein a locating spring is arranged between said bearing and said housing assembly for locating said rotor element at a proper position to define said predetermined gap in said heat generating chamber by biasing said bearing in such a direction that an axial end face of said axle member comes into contact with a confronting axial end faces said drive shaft.

19. The viscous fluid type heat generator of claim 18, wherein at least one of said axial end faces said axle member and said confronting axial end face of said drive shaft is provided with a protrusion for reducing kinetic friction between these axial end faces.

20. The viscous fluid type heat generator of claim 17, wherein said bearing is mounted on said housing assembly in a fixed manner, and wherein said rotor element is located at a proper position to define said predetermined gap in said heat generating chamber by said bearing independently of a mutual contact between an axial end face of said axle member and a confronting axial end face of said drive shaft.

* * * * *